United States Patent [19]

Savage, Jr.

[11] 3,942,669

[45] Mar. 9, 1976

[54] FIRE EXTINGUISHER SUPPORT AND ENCLOSURE STRUCTURE

[76] Inventor: Philip M. Savage, Jr., 45 Linnaean St., Cambridge, Mass. 02138

[22] Filed: Apr. 14, 1975

[21] Appl. No.: 567,769

[52] U.S. Cl. ..... 220/18; 169/51; 220/82 R; 248/310; 312/204; 312/245

[51] Int. Cl.[2] ..... B65D 25/54; B65D 43/12

[58] Field of Search ..... 169/51–53; 248/310, 311; 312/100, 204, 245; 220/4 B, 18, 82 R; 206/45.19, 45.14, 45.31, 446, 486, 806; 222/173, 179.5, 180; 239/273, 282

[56] References Cited

UNITED STATES PATENTS

| | | | |
|---|---|---|---|
| 1,329,655 | 2/1920 | D'Humy | 220/180 UX |
| 1,487,850 | 3/1924 | Miller et al. | 220/82 R |
| 3,067,822 | 12/1962 | Hattenhauer | 169/51 |

*Primary Examiner*—Evon C. Blunk
*Assistant Examiner*—Andres Kashnikow
*Attorney, Agent, or Firm*—David A. Jackson

[57] ABSTRACT

A decorative support and enclosure structure for a small hand-held fire extinguisher is disclosed which possesses a generally rectangular shape with a peaked top and a gabled face configured to resemble an antique fire alarm box. The structure comprises a support member including a horizontal platform, a vertical back wall member continuous therewith, and reinforcement structures comprising paired triangular struts connecting the complementary surfaces of the horizontal platform and the vertical back wall member, and a removably engageable cover comprising the peaked top, the gabled face continuous therewith and parallel opposed side walls, all of which are continuous with the peaked top, and the side walls continuous with the gabled face along opposing vertical edges thereof.

10 Claims, 5 Drawing Figures

EMERGENCY
FDA
11
12
13
14
15
16
17
18
19
20
21
22
23
24
25
26
27
28
29
30
31
32

FIRE EXTINGUISHER SUPPORT AND ENCLOSURE STRUCTURE

BACKGROUND OF THE INVENTION

The present invention relates generally to support and enclosure structures, and particularly to such structures as are useful for the storage and support of safety equipment such as fire extinguishers and the like.

In recent years, there has been growing public concern with safety in all phases of activity, with the result that the federal government has created the Office of Safety and Health Administration (OSHA) to promulgate safety standards in industry and see to their enforcement. An outgrowth of this effort and corresponding public interest has been the proliferation and increased availability of various safety equipment for general consumption which was once manufactured and sold for industrial purposes. Thus, for example, an item such as a hand-held fire extinguisher of a size small enough to fit into the glove compartment of an automobile or a utility closet in a home, is now mass-produced and available to the general public in a large number of stores, including discount variety stores and supermarkets, at prices which make them economically attractive.

Though public acceptance of the hand-held fire extinguisher has been fairly wide, some concern exists regarding the appropriate location of the extinguisher in the home. The appearance of commercially available extinguishers is functional and not particularly attractive, and homeowners tend to store them in areas which are away from general visibility. Further, their size, shape and weight usually affect the choice of their location with the result that they are usually placed in a utility closet, cellar or outside passage and away from the areas where fires most likely occur and/or cause immediate danger and damage.

In view of the above, a need is believed to exist for the provision of a support and enclosure for a fire extinguisher which will prompt household consumers to purchase extinguishers and locate them in easily accessible areas nearby to possible fire hazards.

SUMMARY OF THE INVENTION

In accordance with the present invention, a support and enclosure structure for a small hand-held fire extinguisher is disclosed which comprises a support member including a horizontal platform, a vertical back wall member continuous therewith, and support means connecting the complementary surfaces of said platform and said back wall member, and a removably engageable cover comprising a peaked top, and a gabled face and two parallel opposed side walls all continuous with said top, and said side walls continuous with said face at opposite vertical edges thereof. The resulting structure resembles an antique fire department call box, and may, in a preferred embodiment possess a window centrally located within said face to enable a brief visual inspection of the enclosure to note whether an extinguisher is stored therein.

The enclosure of the present invention possesses an aesthetically pleasing exterior appearance which renders it conducive to conspicuous display in areas of a private dwelling such as the kitchen, living room and the hallway adjacent sleeping quarters where fires are most likely to start. Further, by virtue of its design and construction, the enclosure is capable of being supported upon a horizontal surface such as a shelf or table top, or may be mounted upon a vertical surface such as a wall.

The enclosure of the present invention is of simple construction and may be easily and inexpensively manufactured from a wide variety of materials, including plastics such as synthetic thermoplastic and thermosetting resins.

Accordingly, it is a principal object of the present invention to provide an enclosure and support structure for a fire extinguisher which is aesthetically pleasing for location in visible areas of the home most prone to fires.

It is an additional object of the present invention to provide a structure as aforesaid which is easily and inexpensively manufactured from a variety of readily available materials.

It is a further object of the present invention to provide an enclosure as aforesaid which is capable of mounting on both horizontal and vertical surfaces.

Further objects and advantages will become apparent from the ensuing description which proceeds with reference to the following drawings.

DETAILED DESCRIPTION

Figure 1:
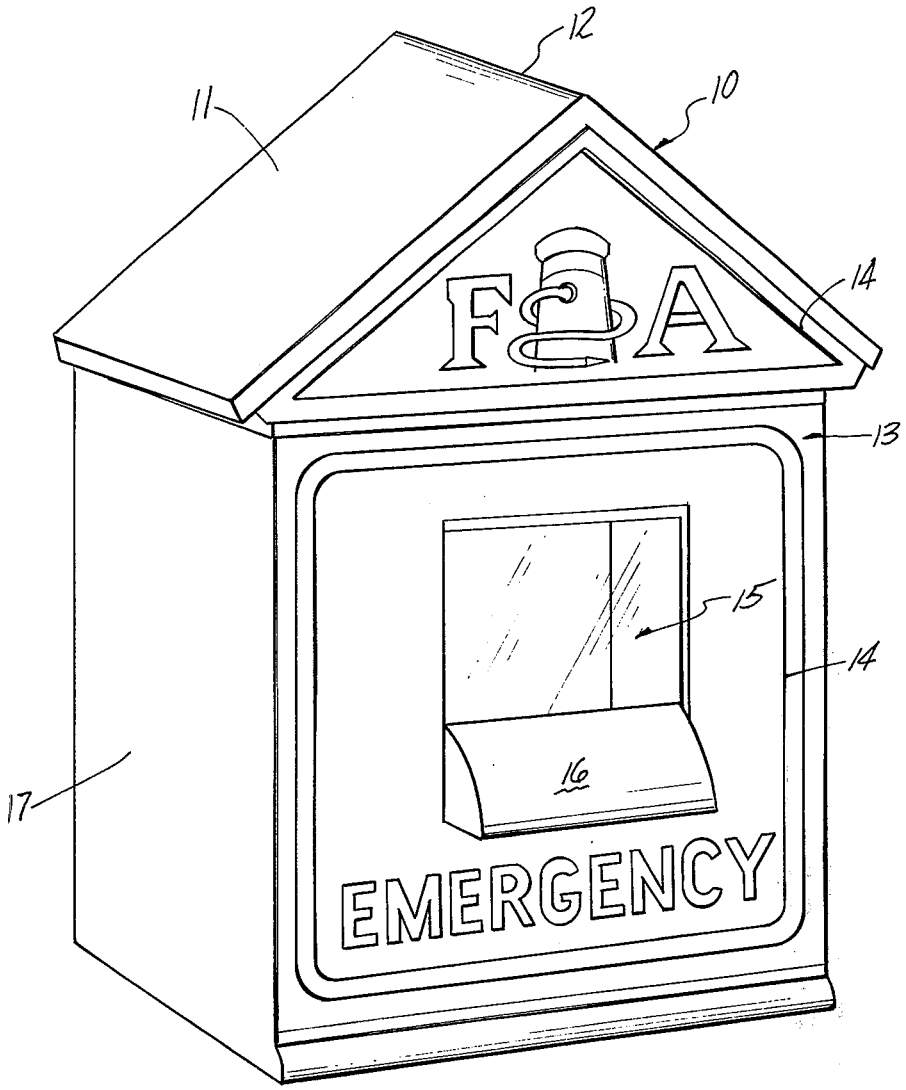
FIG. 1 is a perspective view of the fire extinguisher enclosure in accordance with the invention.

Referring to the drawings where like numerals indicate like parts, and specifically to FIG. 1, the enclosure of the present invention is shown in perspective as possessing a generally rectangular shape with a peaked top 10 comprised of two oppositely inclined rectangular planar roof members 11 which are joined at abutting longitudinal edges to form elongated peak 12. Gabled face 13 is decoratively adorned to resemble a fire alarm call box by the ornamental trim 14, and the placement of a window 15 and a pull-handle 16 in the center thereof. In the use of the enclosure, the outer cover 18, shown more clearly in FIG. 2, may be lifted away from engagement with the support member 20 to enable the removal of the extinguisher. When cover 18 is in place, window 15 may be utilized to visually inspect the enclosure to note whether it contains an extinguisher or is empty.

Figure 2:
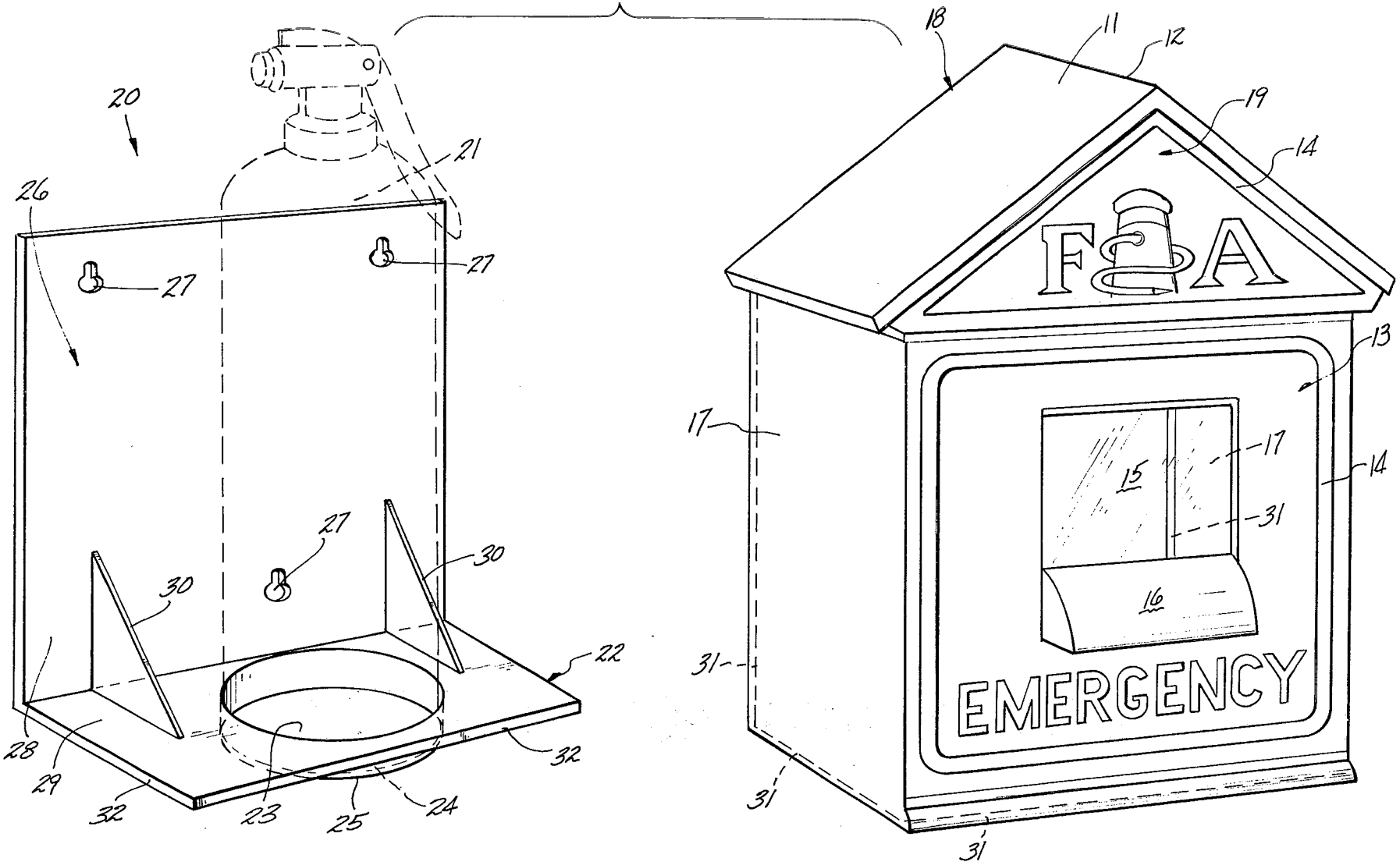
FIG. 2 is an exploded view partly in phantom showing the enclosure of the present invention with a fire extinguisher in place.
Figure 3:
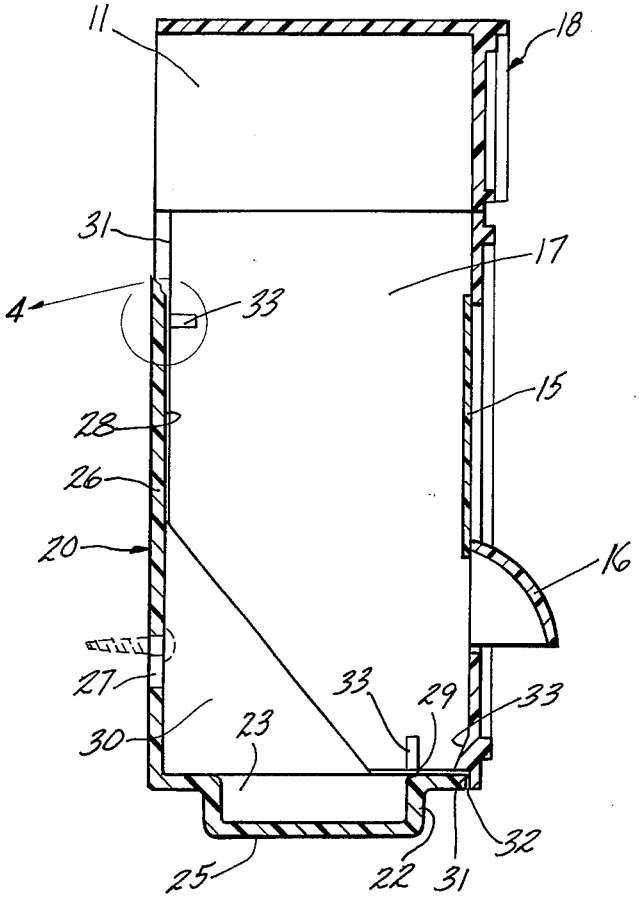
FIG. 3 is a side sectional view partly broken away of the enclosure in accordance with the invention.

Continuing with FIGS. 1 and 2, the enclosure further comprises two opposed side walls 17 situated in parallel planes, each side wall continuous with top 10 at a horizontal edge thereof, and with face 13 at a vertical edge. As clearly depicted in FIG. 2, top 10, face 13 and side walls 17 are joined together as a unit to constitute cover 18, as face 13 is continuous with top 10 at the edges of gabled portion 19. Cover 18 is provided with means, not shown, for engaging support member 20 when placed thereon, located on the free edges of side walls 17 and face 13. The nature of the engagement means and its variations will be discussed later on with reference to FIGS. 3-4A.

In FIG. 2, support member 20 is shown with a fire extinguisher 21, depicted in phantom, located thereon. Support member 20 is comprised of horizontally-extended, rectangular platform 22 which provides direct supporting contact with extinguisher 21 through a depression 23 located centrally therein, which receives the base 24 of the extinguisher. The outer bottom surface 25 of depression 23 is flat and enables the stable location of the enclosure on a flat horizontal surface such as a table top or a shelf.

Connected with platform 22 at a longitudinal edge thereof is upwardly extended vertical back wall member 26, which is adapted for removable mounting attachment to a vertical surface such as a wall or the like. In the illustration of FIG. 2, back wall member 26 is provided with symmetrically positioned eyelets 27 capable of receiving and resting upon nails, screws, wall hangers and the like, which are first fixed in the vertical surface. It is to be understood, however, that the specific manner in which back wall member 26 may be modified for attachment to a vertical surface is not limited within the scope of this invention to the foregoing illustration, but is rather intended to encompass a wide variety of attachment means such as are well known in the art. Also as illustrated, back wall member 26 and platform 22 are disposed in planes perpendicular with respect to each other, so that their respective complementary surfaces 28 and 29 meet and form a right angle. This configuration enables support member 20 to achieve flush engagement with cover 18 when the enclosure is assembled.

When the enclosure is mounted as aforenoted on a vertical surface, platform 22 requires assistance in the support of extinguisher 21. To this end, reinforcement structures 30, comprising, in the illustration, paired triangular struts, are provided integral with and between inner complementary surfaces 28 and 29 to enable back wall member 26 to absorb virtually all of the vertical downward force exerted by extinguisher 21 on platform 22. Platform 22 is thereby able to remain in fixed position relative to back wall member 26, and can indefinitely support the extinguisher. Though only one pair of reinforcement structures is illustrated herein, one may employ a plurality of same, or may alternately increase the thickness of each strut to provide additional weight-carrying capacity. In a preferred embodiment, as will be discussed hereinafter, the enclosure of the present invention is molded as two unitary structures, comprising support member 20 and cover 18, and elements such as support structures 30 are integral with back wall member 26 and platform 22.

As noted above, a feature of the enclosure of the present invention is that it comprises two unitary cooperative structures which are readily and quickly separable to uncover the fire extinguisher in case of need. This is clearly illustrated in FIG. 3, which is a side sectional view of the enclosure of FIG. 1. Cover 18 is in cooperative engagement with support member 20, and is maintained in fixed relation thereto by engagement means which, in a first embodiment, may comprise a longitudinal notch 31 running the length of the free edges of the interior surfaces of side walls 17 and face 13 of cover 18 (shown in phantom in FIG. 2), which is dimensioned to provide a snap-fit engagement with the vertical edges of back wall member 26, and supporting engagement with the free edges 32 (see FIG. 2) of platform 22. As further assurance of proper alignment and fit, cover 18 may be provided with projections 33 which serve to broaden notch 31 to extend over surfaces 28 and 29.

Figure 4:
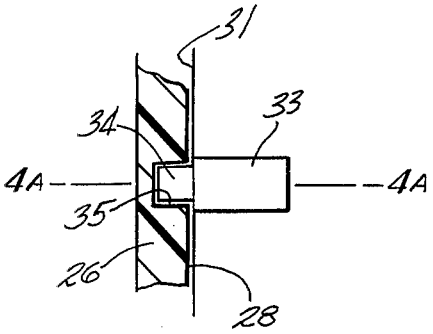
FIG. 4 is a partial exploded section view of FIG. 3.
Figure 4A:
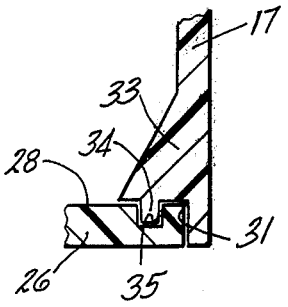
FIG. 4A is a sectional view taken through Line A—A of FIG. 4.

In addition or as an alternate to the above engagement means, projections 33 and the cooperating surfaces 28 and 29, may be modified in the manner depicted in FIGS. 4 and 4A to employ a male-female interlock. Referring to FIGS. 4 and 4A, projection 33 may be modified by the provision thereon of a nipple-like male extension 34 which is directed perpendicularly toward surface 28 of back wall member 26. Correspondingly, back wall member 26 is suitably modified by the provision therein of a mating female detent 35 situated in juxtaposition to extension 34, whereby alignment and engagement therewith assures the alignment and flush fit of cover 18 and support member 20. Though FIGS. 4 and 4A have been labeled to refer to the engagement of side wall 17 with back wall member 26, it is contemplated that the illustrated embodiment may be at other appropriate locations such as between notch 31 and surface 29 of platform 22. Likewise, the invention should not be limited to the specific engagement means illustrated herein, as other means well known in the art may be employed within its scope.

As stated earlier, the enclosure of the present invention may be manufactured from a variety of materials including metals, woods and plastics such as natural and synthetic resins, by processes well known in the art. In a preferred embodiment, the enclosure is prepared from a suitable thermoplastic or thermosetting synthetic resin by an injection molding process, which facilitates the one-piece formation of the support member and the cover. If the cover is to be provided with a window such as is illustrated herein, the cover can be formed leaving an opening for the subsequent installation of a window which, also as illustrated, may be composed of a plastic material (see FIG. 3). The enclosure may be prepared in a variety of colors, though, naturally, red is the color preferred for authenticity. If the preferred manufacturing is to be employed, the plastic starting stock may be mixed to contain the desired color.

It is to be understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within its spirit and scope as defined by the claims.

What is claimed is:

1. A decorative enclosure and support structure for storing a small, hand-held fire extinguisher within a building, said structure comprising a support member comprising a horizontally extended, rectangular platform possessing a depression centrally located therein, said depression adapted to receive the base of said fire extinguisher, an upwardly extended, vertical back wall member integral with said platform at an edge thereof, said back wall member adapted for removable mounting attachment to a vertical support surface, and at least one pair of reinforcement structures connecting said platform and said back wall member for retaining said platform in fixed position relative thereto while under stress; and a cover adapted for removable engagement with said support member, said cover comprising a peaked top, a gabled ornamental face and two parallel opposed side walls, said face and said side walls all integral with said top, and said side walls continuous with said face at opposite vertical edges thereof.

2. The structure of claim 1 wherein said back wall member is adapted for movable vertical mounting by the provision therein of a plurality of eyelets symmetrically disposed therein.

3. The structure of claim 1 wherein said reinforcement structures comprise triangularly-shaped, planar struts in integral with the respective complementary inner surfaces of said back wall member and said platform.

4. The structure of claim 1 wherein said peaked top comprises two oppositely inclined, rectangular planar members continuous with each other at abutting longitudinal edges thereof.

5. The structure of claim 1 wherein said face further includes a window and a handle located therebelow.

6. The structure of claim 1 wherein said cover is adapted for engagement with said support member by the provision on said cover of a continuous notch extending along the free interior edges of said side walls and said face, said notch so dimensioned to facilitate a snap-fit engagement with the corresponding free edges of said support member.

7. The structure of claim 6 further including a plurality of projections laterally inwardly extending from said notch, thereby increasing surface contact with the complementary surfaces of said support structure.

8. The structure of claim 7 wherein projections are provided with male extensions, and said complementary surfaces are provided with female detents therein for engagement with said extensions.

9. The structure of claim 1 wherein said structure is prepared from a material selected from the group consisting of metals, woods, natural resins and synthetic resins.

10. The structure of claim 9 wherein said material comprises synthetic resins suitable for processing by injection molding.

* * * * *